US005791017A

United States Patent [19]

Klüting

[11] Patent Number: 5,791,017

[45] Date of Patent: Aug. 11, 1998

[54] TORSIONAL DOOR LOCK FOR A MOTOR VEHICLE DOOR

[75] Inventor: Bernd-Alfred Klüting, Radevormwald, Germany

[73] Assignee: Ed. Scharwachter GmbH & Co. KG, Remscheid, Germany

[21] Appl. No.: 950,306

[22] Filed: Oct. 14, 1997

Related U.S. Application Data

[63] Continuation of Ser. No. 694,017, Aug. 8, 1996, abandoned.

[30] Foreign Application Priority Data

Mar. 5, 1996 [DE] Germany ..... 196 08 496.2

[51] Int. Cl.[6] ..... E05D 11/10

[52] U.S. Cl. ..... 16/334; 16/332; 16/308; 16/297

[58] Field of Search ..... 16/334, 332, 333, 16/343, 344, 308, 273, 275, 276, 296, 297, 2.1; 384/297, 298, 909, 908

[56] References Cited

U.S. PATENT DOCUMENTS

| | | | |
|---|---|---|---|
| 3,328,100 | 6/1967 | Spokes et al. | 384/298 |
| 3,431,588 | 3/1969 | Frey | 16/334 |
| 3,458,223 | 7/1969 | White | 384/297 |
| 3,500,185 | 3/1970 | Marchione | 16/297 |
| 3,533,668 | 10/1970 | Tunis III | 384/298 |
| 4,285,098 | 8/1981 | Hicks et al. | 16/308 |
| 4,509,870 | 4/1985 | Taki | 384/298 |
| 4,536,918 | 8/1985 | Brockhaus | 16/308 |
| 5,092,017 | 3/1992 | Hatano et al. | 16/342 |
| 5,146,805 | 9/1992 | Harkrader et al. | 16/342 |
| 5,364,682 | 11/1994 | Jacques et al. | 384/298 |
| 5,463,795 | 11/1995 | Carlson et al. | 16/273 |

*Primary Examiner*—Chuck Mah
*Attorney, Agent, or Firm*—Anderson, Kill & Olick, P.C.

[57] ABSTRACT

A torsional door lock for a motor vehicle door including a torsion spring associated with the door or a door pillar and including a weighing arm and torque rod connected to the weighing arm for joint rotation therewith, and an indexing arrangement associated with another of the door or the door pillar and including two indexing rollers cooperating with the weighing arm of the torsion spring for refraining the door in a predetermined indexing position, support axles for supporting the two indexing rollers for rotation thereabout, and bearing sleeves which are made of a maintenance-free bearing material, for rotatably supporting the two indexing rollers on the support axles.

9 Claims, 1 Drawing Sheet

TORSIONAL DOOR LOCK FOR A MOTOR VEHICLE DOOR

This is a continuation of application Ser. No. 08/694,017, filed Aug. 8, 1996, now abandoned.

BACKGROUND OF THE INVENTION

1. Field of the Invention

The present invention relates to a torsional door lock for a motor vehicle door and including a torsional spring formed of a torsion rod connected to a weighing arm for joint rotation therewith and associated with the door or the door pillar, and an indexing arrangement associated with the other of the door or the door pillar.

2. Description of the Prior Art

The torsional door locks are characterized primarily in that the braking and retaining force is obtained by a cooperation of the torsional spring, which is fixedly secured to the door or the door pillar at one of its end, with an indexing arrangement, which is likewise fixedly secured to the other of the door and the door pillar and which has at least one indexing position, with the at least one mutual engagement point of the torsion spring with the indexing arrangement following a circular trajectory concentric with respect to the door hinge axis. At that, it is not important whether the torsional door lock is a separate unit, i.e., is not integral with the door hinge or is made as a single assembly with the door hinge.

In a simplified form of such a torsional door lock, the indexing arrangement is formed as a segment, which extends transverse to the door hinge axis, is secured to the respective door part, and has at least one indexing position on its curved outer surface arranged concentrically with respect to the door hinge axis. The torsion spring is formed as a S- or C-shaped spring bar one bent-off portion of which is connected to its respective door part and the other bent-off portion of which cooperates with the indexing arrangement.

With such a simplified torsional door lock, when a bent-off portion of the torsion spring, which forms the weighing arm, engages in an indexing opening defining the indexing position of the indexing arrangement, a noticeable noise is generated. This highly undesirable noise can be prevented by flattening the indexing position-defining opening of the indexing arrangement. However, in this case, the noise reduction is achieved at a cost of a certain uncertainty of the door stop point and, therefore, of the door opening position.

In order to achieve more precision in obtaining the door stop point, on one hand, and to reduce the noise generated by the torsional door lock, on the other hand, it was proposed to define the indexing position of the indexing arrangement, at least partially, with abutment rollers.

In order to reduce the noise generated by the engagement of the weighing arm of a torsion spring in an indexing opening, U.S. Pat. No. 3,550,185 suggested to form the abutment rollers of a plastic material to thereby achieve an insulation of the impact noise. However, in practice, forming of the abutment rollers of a plastic material resulted either in a premature wear or in an increased cost of the torsional door lock, dependent on what plastic material has been used.

German Patent No. 3,229,766 discloses forming of the indexing position-defining rollers with a predetermined shape of their circumference and from metal and arranging them in such a way that at least two indexing rollers together define an indexing position, at least partially. The advantage of providing two rollers, which define together an indexing position consists in that the weighing arm constantly engages one of the rollers so that a sudden movement of the weighing arm in the indexing position is prevented. Such a construction of a torsional door lock provides for a reduction of the noise but only if it is insured that the weighing arm continuously engages an indexing roller over the entire opening angle of the door. To insure such a continuous engagement of the weighing arm of the torsion spring with an indexing roller, the mutual alignment of the weighing arm and the rollers should be so effected that during the door opening or the door closing movements, the weighing arm can pass without any clearance from the shaped recess of one roller into the shaped recess of the other roller. Naturally, this presupposes the possibility of the rotation of the two rollers relative to each other in opposite direction during the opening and closing movements of the door. At that, the complementing each other shaped recesses of two adjacent indexing rollers should always occupy a predetermined mutual position relative to each other in both rotational directions. To achieve such mutual alignment of two adjacent rollers, it is necessary to correspondingly shape the outer surfaces of the rollers and to insure the roller braking in a predetermined position. The braking is effected with plate springs. However, the unavoidable tolerance deviations, which occur during manufacturing of the torsional door locks, still causes some uncertainty in the door position because even small deviations of the distance between axes of adjacent rollers and/or dimensional deviations of the roller shape result in a discontinuous engagement of the weighing arm with the indexing roller, and this causes some noise though to a smaller degree. The noise, in this case is caused by the movement, albeit small, of the weighing arm which impacts on a respective roller.

In addition, in all conventional torsional door locks, with time, wear and corrosion occur in the roller support which also leads to noise generation which is caused by movement of the rollers due to the formed clearance.

Accordingly, an object of the present invention is a torsional door lock in which noise generation, caused by the corrosion and/or wear of the roller support and by tolerance deviations, is eliminated.

SUMMARY OF THE INVENTION

This and other objects of the present invention, which will become apparent hereinafter, are achieved by mounting the indexing rollers on their respective support axles by using bearing sleeves at least coated with a maintenance-free nonmetal material.

The bearing sleeves or their non-metal portions form an impact noise insulation of the rollers. As a result, the noise, which possibly can be generated by the impact of the weighing arm on the roller, is not transmitted into the body of the indexing element and thereby into a door part which is formed as a hollow body forming a resonance body. Further, using a bearing sleeve formed of a bearing maintenance-free material prevents corrosion of the roller support resulting in the elimination of noise, in particular, of a screeching noise which is caused by corrosion. In addition, forming the insert, at least partially, of a material having at least a limited elasticity, e.g., of a non-metal bearing material, prevents the formation of a clearance in the roller support. The prevention of the clearance formation, on one hand, eliminates a source of noise and, on the other hand, insures a reliable positioning of the rollers and, thereby, a precise location of the stop point of the door during the opening or closing movement of the door. As a non-metal bearing material preferably a plastic material is used because it has very good impact noise insulation and dry running characteristics.

In order to obtain the desired characteristics of the bearing sleeve, it is essential that the sleeve be provided with at least one coating layer formed of a non-metal material and adequate to insure the necessary impact noise isolation. To this end, the entire bearing sleeve can be formed of a plastic material filled with an appropriate filling material. As a filling material, advantageously a non-metal material is used. However, a soft metal, such as lead or the like, can also be used as a filling material. Because the support of the indexing roller during varnishing of the vehicle body is not subjected to any load, a particular strong stabilization of the bearing sleeve is not absolutely necessary. Advantageously, however, taken into consideration the requirements of an automatic mounting of the indexing rollers, the stabilization of the bearing sleeve, is desirable. The stabilization of a bearing sleeve can be achieved by forming of the bearing sleeve of an appropriate bearing material with at least two coating layers, with at least one layer being formed of a non-metal material and having a strength sufficient to insure the impact noise isolation.

Accordingly to a preferred embodiment of the invention, the bearing sleeve is formed, in per se known manner, of a wire mesh with a coating layer which is formed of a flowable plastic material, if necessary, filled with a filling material, covering the wire mesh outer surface and filling the wire mesh gaps. The wire mesh is formed of a metal, which is elastically deformable within certain limits, so that a limited elastic deformation of the bearing sleeve under the action of very high impact forces, which acts during actuation of the door lock, is possible. In this way, the bearing sleeve absorbs an impact of the weighing arm on a roller, which may be caused by tolerance deviations, and prevents the transmission of the impact forces to the respective door part.

In a further development of the invention, it is contemplated to insert the bearing sleeve into the roller with a predetermined radial force which insures a backlash-free mounting of the roller, independent of the manufacturing tolerances. This also permits to prevent an unintended rotation of the indexing roller which excludes an independent movement of the indexing roller after it is disengaged from the weighing arm of the torsion spring, so that the use of special braking means, such as plate spring or the like, becomes unnecessary.

The present invention is not associated with a particular type of a torsional door lock or its construction, nor with a particular design of the bearing sleeve. Rather, within the scope of the invention, any suitable design of a bearing sleeve can be used which would insure, on one hand, a reliable impact noise isolation and, on the other hand, a durable backlash-free and corrosion-free support of the indexing roller.

The present invention, as it has been mentioned above, is not associated with a particular design of the bearing sleeve. Rather, the shape or the design of the bearing sleeve is influenced by the properties of the non-metal bearing material used for its manufacture. In the simplest case, the bearing sleeve can be formed as a pure cylindrical sleeve. However, it may be advantageous to form the bearing sleeve with a collar engaging the bottom of the indexing roller.

BRIEF DESCRIPTION OF THE DRAWINGS

The features and objects of the present invention will become more apparent, and the invention itself will be best understood from the following detailed description of the preferred embodiments when read with reference to the accompany drawings, wherein.

DETAILED DESCRIPTION OF THE PREFERRED EMBODIMENT

Figure 1:
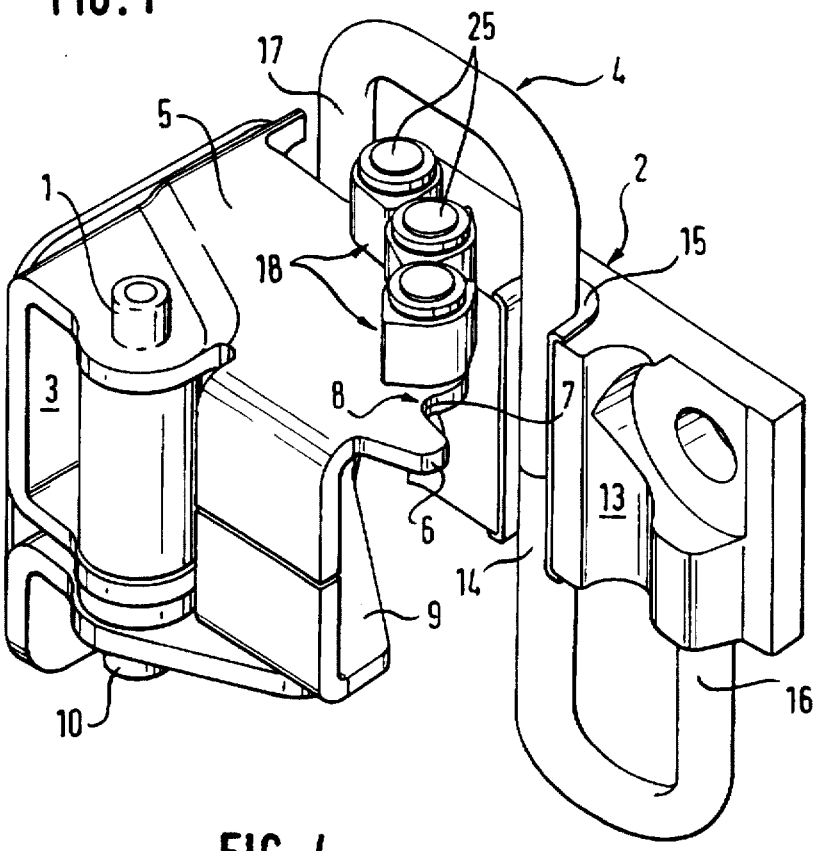
FIG. 1 is a perspective view of a door hinge assembly including a door hinge and a torsional door lock according to the present invention.
Figure 2:
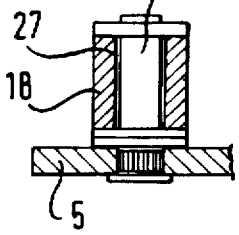
FIG. 2 is a cross-sectional view of the indexing roller of the torsional door lock shown in FIG. 1.
Figure 4:
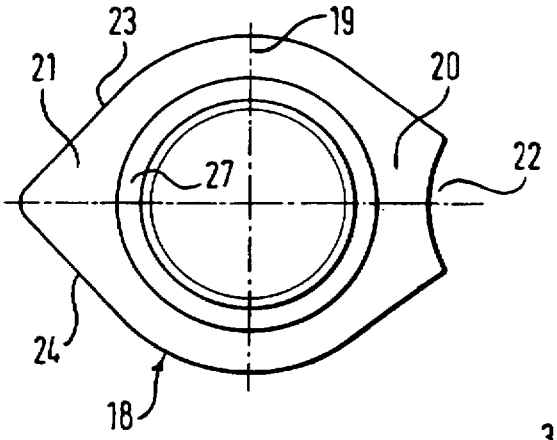
FIG. 4 is a plan view of the indexing roller shown in FIG. 2.

FIG. 1 shows a door hinge assembly for a demountable door of a motor vehicle. The door hinge assembly includes a hinge formed of two hinge flaps 2 and 3 pivotally connected with each other by a hinge pin 1, with the hinge flap 2 being attached to the vehicle door and the hinge flap 3 being releasably attached to the vehicle door pillar. The door and the door pillar are not shown in the drawings. The door hinge assembly shown in FIG. 1 further includes a torsional door lock 4 formed according to the present invention. The hinge flap 3 is formed of a sheet material section bent to a U-shape. An indexing arrangement 8, which is formed of following each other projections 6 and recesses 7, is formed on an upper leg 5 of the U-shaped section which extends transverse to the hinge axis. On the lower leg 9 of the U-shaped section, which likewise extends transverse to the hinge axis, there is provided a peg-shaped projection (not shown) extending parallel to an extension 10 of the hinge prior 1 which extends beyond the hinge height. The hinge flap 2 has an approximately L-shaped cross-section. One leg of the L-shaped hinge flap 2 is connected with the hinge flap 3 by the hinge pin 1, pivotally connecting the hinge flap 2 with the hinge flap 3. The other leg 13 of the L-shaped hinge flap 2 of the L-shaped hinge flap 2 is attached to the vehicle door.

The torsional door lock 4 which, as discussed above, forms an integral assembly with the door hinge, includes a S-shaped member comprising a shaft portion 14, which is held in a bearing shell 15 formed integrally with the hinge flap 2, and a support arm 16 supported against the hinge flap 2. The S-shaped member defines the torsion spring of the torsional door lock 4. The weighing arm 17 of the s-shaped member projects above both hinge flaps 2 and 3. The weighing arm 17 of the S-shaped member, the torsion spring, cooperates with indexing device 8, the following each other projections 6 and the recesses 7 define three indexing position of the vehicle door. The indexing means of the indexing device 8, which cooperates with the weighing arm 17 to reframe the door in the three indexing position, comprises three, arrange one behind the other, identical indexing rollers 18 rotatable about support axles 25 supported in respective projections 6. The indexing rollers 18 have each a central circular region 19 with two radically extending overhangs 20 and 21, with one of the overhangs overhang 20, having a recess 22 and the other overhang, overhang 21, having a wedge-like shape.

The recess 22 of the overhang 20 has an arcuate cross-section corresponding to the cross-section of the weighing arm 17, with two recesses 22 of adjacent indexing rollers 18 forming a semi-circle. The two side surfaces 23 and 24 of each of the radial projection 21 form an angle of 97° with each other, so that radial projections 21 of the two adjacent indexing rollers 18, which rotate in opposite directions, form a stop for limiting the pivotal movement of a respective roller. Thus, the maximum possible angular pivotal movement of each roller is limited to 97°. The indexing roller 18 are supported on the respective axles 15 with bearing sleeves 27.

Figure 3:
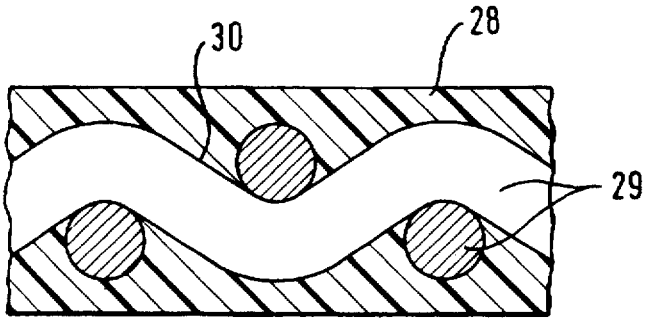
FIG. 3 is a schemative cross-sectional view at an increased scale of a possible embodiment of a bearing shell of a torsional door lock according to the present invention.

As shown in FIG. 3, the bearing sleeve 27 is formed of a wire mesh 29 covered with a layer 28 of a maintenance-free non-metallic bearing material. The non-metallic bearing material consists of a plastic material filled with a non-metallic filling material. The bearing material fills the gaps 30 of the wire mesh 29 and thereby is anchored to the wire mesh 29. The wire mesh 29 is formed of an elastically deformable, within certain limits, non-ferrous material. The wire mesh 29 forms a support frame for the bearing layer 29 which is provided on both sides of the wire mesh 29. The bearing sleeve 2 is pressed in into the indexing roller 18, insuring a backlash-free support of the indexing roller, without regard to the manufacturing tolerances.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A torsional door lock for a motor vehicle door, comprising:

a torsion spring associated with one of the door and a door pillar and including a weighing arm and a torque rod connected to the weighing arm for joint rotation therewith; and an indexing arrangement associated with another of the door and the door pillar and including at least two indexing rollers engageable with each other and cooperating with the weighing arm of the torsion spring for retaining the door in a predetermined indexing position, support axles for supporting the at least two indexing rollers for rotation thereabout, and bearing sleeves for rotationably supporting the at least two indexing rollers on respective support axles, wherein the at least two indexing rollers have each a circumferential profile formed of a central circular region and two radially extending overhangs located opposite each other with respect to the central circular region, with one overhang having a recess formed therein and another overhang having a wedge-like shape defined by side surfaces of the another overhang extending relative to each other at an angle of about 97°, whereby the wedge-like shaped overhang of one of the at least two indexing rollers forms a stop for another of the at least two indexing rollers upon rotation of the at least two indexing rollers to about 97°, wherein the bearing sleeves have each a noise-insulating coating layer formed at least partially of an elastic, maintenance-free, non-metallic material, and wherein the bearing sleeves are inserted in respective indexing roller openings under a predetermined radial pressure.

2. A torsional door lock as set forth in claim 1, wherein the maintenance-free non-metallic material comprises a plastic material filled with non-metallic filling material.

3. A torsional door lock as set forth in claim 1, wherein the bearing sleeves comprise a second coating layer formed of a bearing material.

4. A torsional door lock as set forth in claim 1, wherein the bearing sleeve comprises a wire mesh covered with the at least one layer of maintenance-free bearing plastic material.

5. A torsional door lock as set forth in claim 4, wherein the maintenance-free bearing material is a plastic material.

6. A torsion door lock as set forth in claim 4, wherein the wire mesh is formed of an elastically deformable metal.

7. A torsional door lock as set forth in claim 1, wherein the bearing sleeve comprises a wire mesh covered with the at least one coating layer formed a non-metallic bearing plastic material filled with a non-metallic filling material, the maintenance-free non-metallic material filling gaps of the wire mesh and covering an outer surface thereof.

8. A torsional door lock as set forth in claim 7, wherein the non-metallic bearing material is a plastic material.

9. A torsional door lock as set forth in claim 1, wherein the bearing sleeve are formed as completely cylindrical sleeves.

* * * * *